United States Patent [19]

Parker

[11] Patent Number: 5,056,644

[45] **Date of Patent: * Oct. 15, 1991**

[54] COIN ANALYZER SYSTEM AND APPARATUS

[76] Inventor: Donald O. Parker, 1003 Spring St., Grand Rapids, Mich. 49503

[ * ] Notice: The portion of the term of this patent subsequent to Dec. 5, 2006 has been disclaimed.

[21] Appl. No.: 390,522

[22] Filed: Aug. 7, 1989

Related U.S. Application Data

[63] Continuation of Ser. No. 231,697, Aug. 12, 1988, Pat. No. 4,884,672.

[51] Int. Cl.[5] ..... G07D 5/08; G07F 3/02

[52] U.S. Cl. ..... 194/318; 194/346

[58] Field of Search ..... 194/205, 213, 303, 317, 194/318, 319, 321, 323, 346; 73/163; 324/236, 234

[56] References Cited

U.S. PATENT DOCUMENTS

| | | | |
|---|---|---|---|
| 2,589,214 | 3/1952 | Andrews . | |
| 3,059,749 | 10/1962 | Zinke . | |
| 3,152,677 | 10/1964 | Phillips . | |
| 3,481,443 | 12/1969 | Meloni . | |
| 3,599,771 | 8/1971 | Hinterstocker . | |
| 3,741,363 | 6/1973 | Hinterstocker . | |
| 3,749,220 | 7/1973 | Tabiichi et al. | 194/319 |
| 3,796,295 | 3/1974 | Montolivo et al. . | |
| 3,837,454 | 9/1974 | Joeck . | |
| 3,870,137 | 3/1975 | Fougere . | |
| 4,089,400 | 5/1978 | Gregory, Jr. . | |
| 4,254,857 | 3/1981 | Lavasseur et al. . | |
| 4,298,116 | 11/1981 | Niemeyer . | |
| 4,432,441 | 2/1984 | Tonaka . | |
| 4,437,558 | 3/1984 | Nicholson et al. . | |
| 4,441,602 | 4/1984 | Ostroski et al. . | |
| 4,465,173 | 8/1984 | Domen et al. . | |
| 4,469,213 | 9/1984 | Nicholson et al. . | |
| 4,625,851 | 12/1986 | Johnson et al. . | |

FOREIGN PATENT DOCUMENTS

| | | |
|---|---|---|
| 2069211 | 8/1981 | United Kingdom . |

*Primary Examiner*—F. J. Bartuska

*Attorney, Agent, or Firm*—Price, Heneveld, Cooper, DeWitt & Litton

[57] ABSTRACT

A coin analyzer system and apparatus that provides a detection circuit for comparing a tested coin with at least two different sample coins. Two different sample coins are located in a magnetic field, and the tested coins pass through another region of the magnetic field. In the event the tested coin does not match either sample coin, a rejecting gate forces the tested coin out of the coin chute in a laterally normal direction and into a rejected coin chute. In the event that the tested coin matches either sample coin, the rejecting gate is opened and the tested coin drops through a substantially vertical accepted coin chute. Credit is not extended the tested coin until the coin passes a confirmation sensor, and the determining circuit may be adjusted to vary the credit value extended to at least one of the sample coins. A lockout circuit rejects and prevents a subsequent coin from being analyzed during the time that the circuit is crediting a prior tested coin with multiple credits.

12 Claims, 5 Drawing Sheets

COIN ANALYZER SYSTEM AND APPARATUS

This is a continuation of application Ser. No. 231,697, filed Aug. 12, 1988, now U.S. Pat. No. 4,884,672.

BACKGROUND OF THE INVENTION

The present invention relates to coin analyzer devices, and in particular to coin analyzer devices that are used in the control or operation of coin operated machines such as, for example, video games and other coin operated games, car washes, clothes washers and dryers and the like.

A wide variety of coin detectors and coin analyzing devices have been developed for use with coin operated machines. These devices perform a variety of different functions, among those functions being, for example, the rejecting of slugs or other improper coins, generating a credit or value in response to the deposit of coin, or determining the value of a given coin. These devices encompass a variety of both mechanical and electrical constructions, and vary according to the particular coin operated device that the coin analyzer or detector is to be operated with. These coin analyzers or detectors are used in various environments, such as video and other coin operated games, car washes, clothes washers and dryers and the like. An example of one such coin analyzer or detector is shown in U.S. Pat. No. 4,437,558, of which I am co-inventor. That patent discloses an apparatus that employs a spaced three coil stack used to compare a test coin and a sample coin placed within the stack. The coin to be tested is passed through the coil stack, and a magnetic field is generated between the coils. The device incorporates an electronic circuit that evaluates the quality of the output from the coils in order to determine if the tested coin matches with the sample coin. In the event that the test coin matches, the test coin is accepted and a credit is given. In the event that the tested coin does not match the sample coin, the tested coin is rejected and no credit is given. Although this structure operates well, this structure is limited to a single coin and value of credit given.

In the past coin detectors and analyzers have been used with coins of different denominations. Coin detectors have also been used in the past to accept and extend credit in return for various tokens that a given establishment may handle for use in its coin operated machines. The use of tokens provides several security benefits, allows the value of the token to be selected without any relationship to the face value of the token itself, and reduces the number of actual coins which must be handled since the tokens may be purchased and redeemed with other currency. Nonetheless, the use of actual coins in a machine is often far more convenient to the customer than having to purchase special tokens for operation of the machine. Since most coin analyzer devices accept only a single type of coin, any given establishment may provide machines that only accept actual coins, may operate machines that only accept tokens, or may provide a mixture of coin operated and token operated machines. In many instances it would be beneficial to both the machine owner and customer to provide coin operated machines that can accept and extend credit to both coins and tokens, so that the customer may select which form of payment is preferred.

Heretofore, in order to provide a coin operated machine that accepts both coins and tokens, two separate coin detectors or analyzers were required, one for coins and a separate unit for tokens. This dual unit arrangement greatly increases the space required in the underlying coin operated machine for the coin accepting apparatus alone, as well as increasing the expense of the coin accepting mechanism. In some environments the coin operated machine does not have sufficient space to accommodate two coin analyzer units. Further, when two separate coin analyzer units are utilized, the user quite often places the coin or token in the wrong insert slot, resulting in no credit being extended and often jamming the coin acceptor unit. Such a dual coin analyzer arrangement is therefore generally unsatisfactory as well as uneconomical.

SUMMARY OF THE INVENTION

The present invention is embodied in an apparatus that analyzes a plurality of different coins or tokens. The coin analyzer will accept and provide appropriate credit for at least two preselected types of coins or tokens, with all of the coins to be tested being inserted through the same inlet. Two sets of field generating-sensing coils seat two different sample coins, and are connected in a circuit with a set of test coils. As a coin to be tested is slid between the test coils, the circuit compares the output of the test coils with the two outputs of the sample coin coils. In the event that the test coil output matches the output of either set of sample coin coils, the tested coin is accepted. The circuit also includes a confirmation sensor that, as the accepted coin continues to pass through the apparatus and reaches the sensor, confirms that the coin has been properly inserted and extends credit. If the test coil output does not match the output of either set of sample coin coils, the tested coin is rejected and no credit is given.

In a preferred embodiment, the circuit permits the adjustment of at least one of the credit values extended upon a match with one of the sample coins. For this reason the credit value for the adjustable sample coin may be varied in relation to the other sample coin, which provides the apparatus with the ability to selectively vary the value of a token used with the underlying coin operated machine. This beneficially permits the machine owner to adjust an increased value of a token, for example, in order to reduce the number of tokens or coins that a user must carry, yet still permit normal coins to be used in the machine.

The coin analyzer apparatus also preferably includes a lockout circuit that prevents a new coin to be tested from being analyzed until after an increased value token has been credited by the apparatus. This prevents a user from failing to receive credit in the event that a proper coin is inserted too quickly while the coin analyzer is extending a multiple credit to a previous coin. This lockout circuit also beneficially prevents an erroneous multiple credit from being extended to a single coin.

Preferably, the coin rejecting gate moves a rejected test coin laterally normal to the accepted coin chute in order to direct the tested coin into a rejected coin chute. The accepted coin chute extends downwardly generally vertically from the test region so that an accepted coin drops substantially straight down toward the coin collecting box within the machine, thus reducing the chances of jamming within the apparatus.

Since an accepted genuine tested coin is not extended credit until the tested coin passes a rejecting gate and a confirming sensor that closes the gate, the coin is prevented from being withdrawn back up through the inlet. This provides a safeguard that prevents the user from cheating the apparatus such as by securing a line to a genuine coin. With the present coin analyzer apparatus two separate coins of different denomination may be used in the same machine, or a coin and a token may be used. The value of the token in relation to the other coin may be varied, yet only a single coin analyzer unit is required with only a single insert slot, and the proper credit value is extended to the user regardless of which coin or token is inserted into the apparatus. It will be recognized that the provision of a single analyzer unit reduces the space otherwise necessary for a two coin analyzing mechanism, as well as reduces the associated cost. These and other benefits, functions and objects of the invention will be recognized by one skilled in the art from the description and claims which follow and drawings appended hereto.

DETAILED DESCRIPTION OF THE PREFERRED EMBODIMENTS

Figure 1:
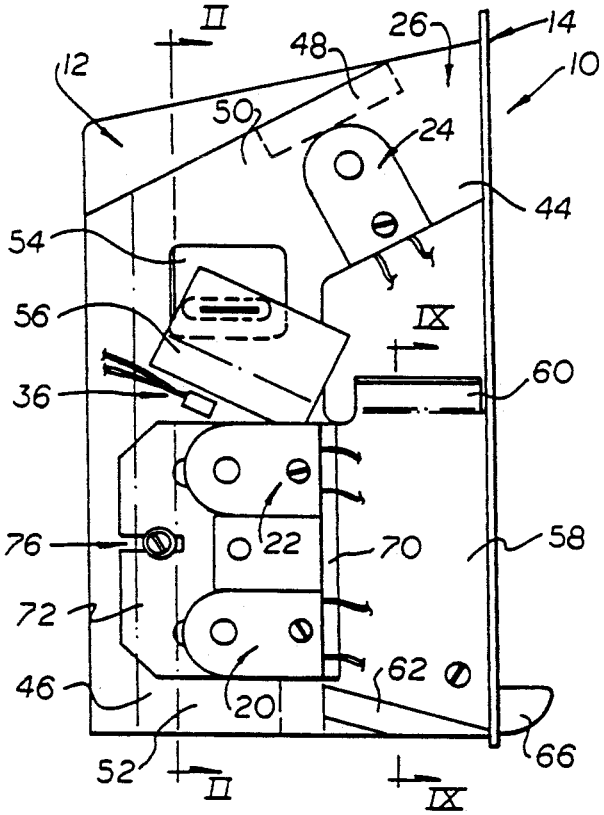
FIG. 1 is a side elevational view of a coin analyzer apparatus embodying the present invention.
Figure 2:
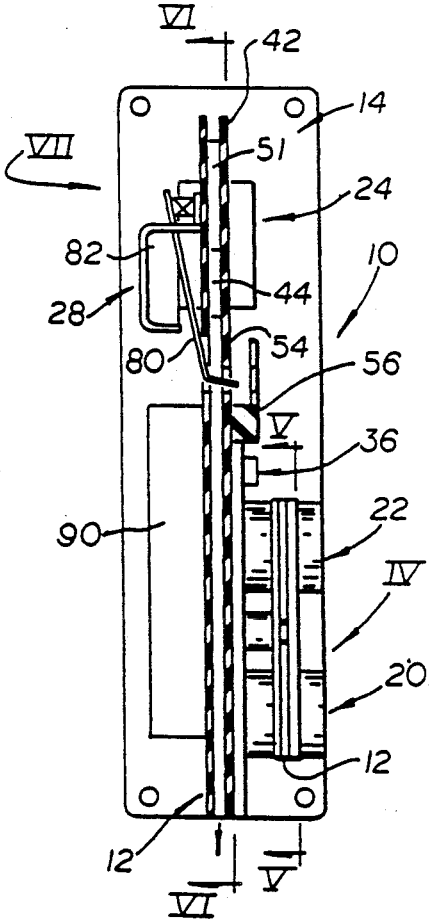
FIG. 2 is a rear sectional view of the coin analyzer apparatus taken along plane II—II of FIG. 1.
Figure 3:
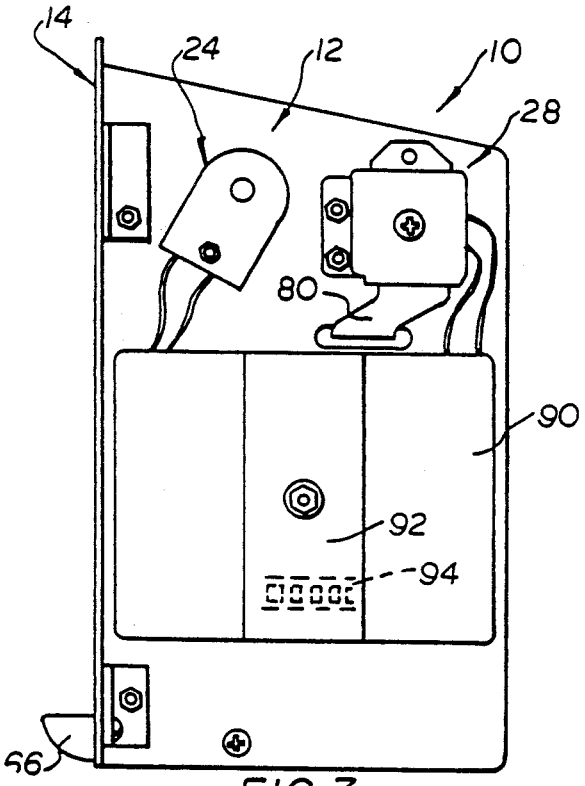
FIG. 3 is an opposite side elevational view of the coin analyzer apparatus of FIG. 1.
Figure 4:
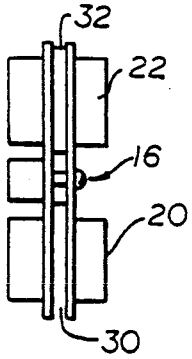
FIG. 4 is a rear elevational view of the sample coin mounting region of the apparatus taken in the region of arrow IV in FIG. 2, shown with the mounting bracket removed.
Figure 5:
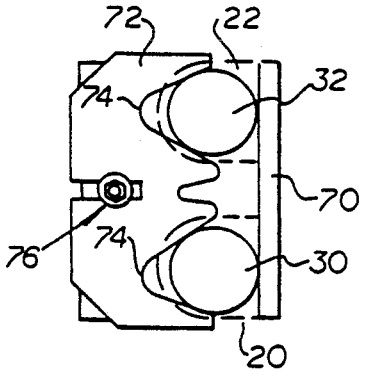
FIG. 5 is a side sectional view of the sample coin mounting region taken along plane V—V of FIG. 2.
Figure 6:
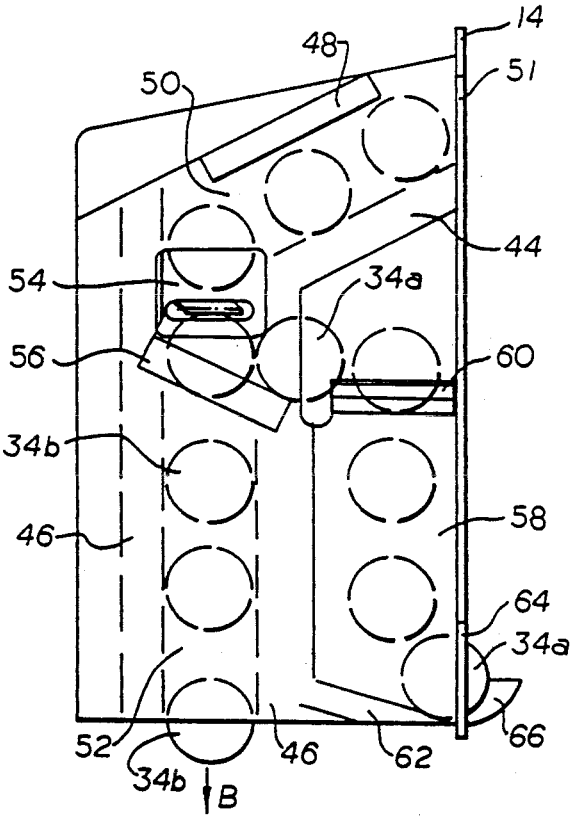
FIG. 6 is a side sectional view of the coin analyzer apparatus taken along plane VI—VI of FIG. 2, showing the path travelled by both an accepted coin and a rejected coin.

The present invention is embodied in a coin analyzer device, a preferred form of which is shown in FIGS. 1–3 and referenced generally by the numeral 10. Apparatus 10 includes a circuit supporting base plate 12 which is connected to a front mounting panel 14. Mounted on base plate 12 are two sample coin coil assemblies 20 and 22. A tested coin coil assembly 24 is mounted toward the upper end of base plate 12. A coin chute 26 extends from the upper front region of base plate 12, through tested coin coil assembly 24 and then downwardly to the bottom of base plate 12. Also located at the upper region of base plate 12 is a kicker mechanism 28 (FIG. 3). Sample coins 30 and 32 (FIGS. 4, 5) are selected and positioned in sample coin coil assemblies 20 and 22, respectively, and form the basis for comparing or testing a tested coin 34 (FIG. 6). At coin chute 26 and beneath kicker mechanism 28 is a confirmation sensor 36. Sample coin coil assemblies 20 and 22 are connected in a detection circuit 40 (FIG. 10), along with tested coin coil assembly 24, kicker mechanism 26 and confirmation sensor 36. In operation, after sample coins 30 and 32 have been secured in sample coin coil assemblies 20 and 22, tested coin 34 is slid along coin chute 26 so as to pass through tested coin coil assembly 24. In the event that detection circuit 40 determines tested coin 34 matches with either one of sample coins 30 and 32, kicker mechanism 28 is shifted into an accepted condition (FIG. 8). Tested coin 34 continues down coin chute 26 past confirmation sensor 36, at which point credit is extended. In the event that detection circuit 40 determines tested coin 34 does not match either sample coin 30 or 32, kicker mechanism 28 is maintained in a rejection condition (FIG. 7) and tested coin 34 is returned to the user.

More specifically base plate 12 is a planar circuit mounting panel that is riveted or otherwise suitably joined to mounting panel 14 so as to extend at right angles rearwardly from panel 14. Mounting panel 14 is of conventional planar shape configured and dimensioned to mount on conventional coin operated machines. Mounting panel 14 is removably mounted on the underlying coin operated machine in conventional fashion by screws, clamps, or other suitable releasable fasteners, so that coin analyzer apparatus 10 may be readily removed from the coin operated machine for service.

Coin chute 26 is formed by a viewing panel 42 that is secured to but spaced from base plate 12 so a to provide a gap slightly larger than the width of an average coin. Viewing panel 42 is preferably a transparent plastic material so as to provide for visual inspection of coin chute 26 and any potentially jammed tested coins 34. Viewing panel 42 is spaced from base plate 12 by a declined ramp bracket 44, vertical brackets 46 and an upper positioning bracket 48. Upper positioning bracket 48 is sloped parallel to ramp bracket 44. Ramp bracket and upper positioning bracket 48 define a test region 50 (FIG. 1) of coin chute 26 through which tested coin 34 rolls. A coin inlet slot 51 (FIGS. 2, 6) opens through mounting panel 14 and into test region 50. After test region 50, vertical brackets 46 define a vertically oriented accepted coin chute 52 that extends downwardly substantially vertically toward the accepted coin storage box (not shown) within the coin operated machine.

Figure 9:
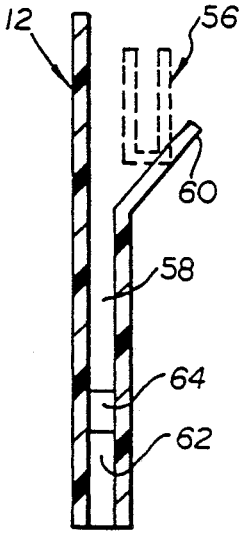
FIG. 9 is a sectional view of the rejected coin chute of the coin analyzer apparatus taken along plane IX—IX of FIG. 9.

At the upper end of accepted coin chute 52 is a rejected coin port 54 (FIGS. 1, 2). Rejected coin port 54 is larger than the diameter of tested coin 34 so that a rejected tested coin 34 may be forced in a direction laterally normal to the direction of travel along coin chute 26, and through rejected coin port 54. "Laterally normal" refers to a direction normal to the circular face of the coin. Immediately adjacent rejected coin port 54 is a downwardly sloped rejected coin ramp 56. Rejected coin ramp 56 has a side wall that is spaced from viewing panel 4 and extends upwardly sufficient to deflect and direct rejected tested coin 34 down rejected coin ramp 56. Located at the end of rejected coin ramp 56 is a rejected coin chute 58 (FIGS. 1, 9). Rejected coin chute 58 has a sloped upper end 60. Sloped upper end 60 operates as a funnel to slide a rejected tested coin 34 back toward base plate 12 as tested coin 34 drops down into rejected coin chute 58. At the base of rejected coin chute 48 is a lower ramp 62. Lower ramp 62 rolls a rejected tested coin 34 through a lower rejected coin slot 64 (FIG. 6) through the lower end of mounting panel 14. A rejected coin trough 66 collects rejected tested coin 34 at coin slot 64 for retrieval by the user.

It is to be recognized that, as used herein, "coin", "tested coin", and "sample coin" refer to tokens as well as actual currency of any selected denomination.

Sample coin coil assemblies 20 and 22 each include two spaced electromagnetic coils that are mounted on the planar face of viewing panel 42. Sample coin coil assemblies 20, 22 are mounted on viewing panel 42 at accepted coin chute 52 so that accepted tested coin 34 drops down behind sample coin coil assemblies 20, 22. In the event that the coin storage box becomes filled and accepted coins begin backing up accepted coin chute 52, the backed up coins will eventually back up directly behind sample coin coil assembly 20. With a coin situated in accepted coin chute 52 directly behind sample coin coil assembly 20 the field of sample coin coil assembly 20 will be so affected that no match can occur between a genuine tested coin 34 and sample coin 30, so that kicker mechanism 28 remains in a rejection condition and no further tested coins 34 will be accepted. In the event that a coin jams in accepted coin chute 52 behind sample coin coil assembly 22 and genuine tested coins 34 back up that far, kicker mechanism 28 will similarly reject all further tested coins 34.

A spacer bar 70 (FIG. 5) separates the coils of both sample coin coil assemblies 20 and 22, as well as closes the gap between the coils along one side of sample coin assemblies 20, 22 and provides a positioning stop for sample coins 30 and 32. Spacer bar 70 has a thickness slightly greater than sample coins 30 and 32. Sample coins 30 and 32 may therefore be slid into sample coin coil assemblies 20 and 22 yet still maintain sufficiently proximity with the coils. An adjustable securing bracket 72 is used to clamp sample coins 30 and 32 against spacer bar 70. Securing bracket 72 has two recessed seats 74 that contact the outer edges of sample coins 30 and 32. Seats 74 are tapered in order to accommodate coins having different diameters. An adjustment bolt and slot 76 permit securing bracket 72 to be slid against sample coins 30 and 32 and then bolted into place in order to securely position sample coins 30, 32 in sample coin coil assemblies 20, 22. Alternatively securing bracket 72 may be broken into two elements, each element having a separate adjustment bolt and slot so as to permit the clamping of each sample coin 30, 32 to be separately adjusted.

Tested coin coil assembly 24 is mounted at test region 50 (FIGS. 1, 3) with the coils spaced by base plate 12 and viewing panel 42. Tested coin 34 therefore rolls along ramp bracket 44 through tested coin coil assembly 24. Upper positioning bracket 48 maintains the positioning of tested coin 34 and prevents tested coin 34 from bouncing upwardly out of tested coin coil assembly 24, thus avoiding an erroneous reading of tested coin 34.

Alternatively, upper positioning bracket 48 may be adjustably mounted between base plate 12 and viewing panel 42. In this alternative embodiment, the spacing between upper positioning bracket 48 and ramp bracket 44 may be adjusted in order to accommodate tested coins 34 having different diameters.

Figure 7:
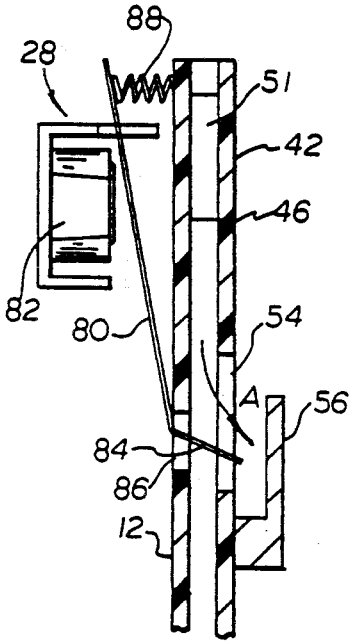
FIG. 7 is a fragmentary rear view of the test region of the coin analyzer apparatus taken in the region of arrow VII in FIG. 2, showing the coin analyzer apparatus in a reject condition.
Figure 8:
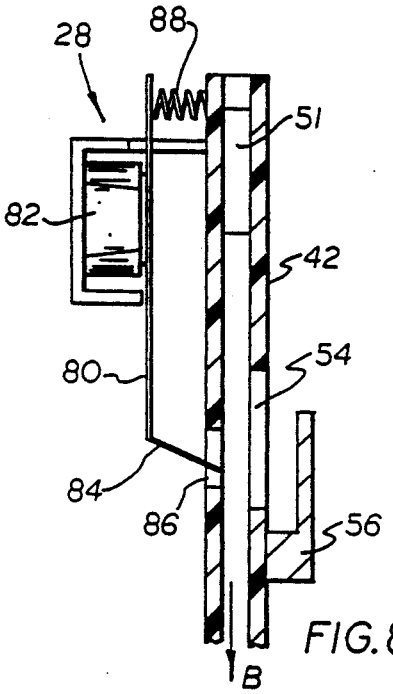
FIG. 8 is a fragmentary rear elevational view of the coin test region shown in FIG. 7, as shown with the coin analyzer apparatus in an acceptance condition.

As best shown in FIGS. 7 and 8, kicker mechanism 28 includes a metal kicker gate 80. Kicker gate 80 is pivotally mounted adjacent an electromagnetic kicker coil 82. Kicker gate 80 has a lower end 84 that is angled so as to be received through a gate aperture 86 in base plate 12. A return spring 88 mounted between the upper end of kicker gate 80 and base plate 12 biases kicker gate 80 toward a rejection condition shown in FIG. 7. In a rejection condition, kicker gate lower end 84 extends through gate aperture 86, and slopes downwardly across the gap of coin chute 26 to rejected coin port 54. In the rejection condition a tested coin 34 is slid laterally normally out through rejected coin port 54 and onto rejected coin ramp 56 in the direction of arrow A (FIG. 7).

When kicker coil 82 is energized, metal kicker gate 80 is magnetically pivoted so that lower end 84 is pulled back through gate aperture 86. Kicker mechanism 28 is thus shifted to the coin acceptance condition shown in FIG. 8, and tested coin 34 is permitted to drop down through accepted coin chute 52 in the direction of arrow B. When kicker coil 82 is de-energized, return spring 88 biases kicker gate 80 toward the at-rest coin rejecting condition shown in FIG. 7.

Confirmation sensor 36 is most preferably a photoelectric sensor located just slightly less than a coin-diameter beneath gate aperture 86. Confirmation sensor 36 is mounted on viewing panel 42 and mounting panel 14 so as to produce a sensing beam directed back across accepted coin chute 52. Confirmation sensor 36 is coupled with detection circuit 40 so that as an accepted tested coin 34 passes confirmation sensor 36, an appropriate credit is extended to the user and kicker mechanism 28 is reset with kicker gate 80 being shifted back to the rejection condition. Since confirmation sensor 36 is located just slightly less than a coin-diameter beneath gate aperture 86, at the point that credit is extended to tested coin 34 kicker gate lower end 84 and kicker gate 80 closes above tested coin 34 with tested coin 34 still blocking confirmation sensor 36. Tested coin 34 is thus prevented from being withdrawn back up accepted coin chute 52 and detection circuit 40 is locked in an indeterminate state due to the blocking of confirmation sensor 36, thereby preventing a user from cheating apparatus 10. Further, in the event that a coin jam develops in accepted coin chute 52, when genuine tested coins 34 back up to confirmation sensor 36 kicker mechanism 28 will be locked in a rejection condition, thus preventing the coin jam from backing up further.

A circuit enclosure 90 houses the remainder of detection circuit 40. A credit adjustment cover 92 is bolted to the rear of circuit enclosure 90. Credit adjustment cover 92 releasably covers switches 94. Switches 94 adjust the credit value accorded sample coin 32. Most preferably coin analyzer apparatus 10 includes four or five switches 94 which adjust the credit value accorded sample coin 32 in incremental multiples of the credit value accorded sample coin 30. Thus, if sample coin 30 is accorded a credit value of a quarter, sample coin 32 may be adjusted to incremental multiples of a quarter. Alternatively, detection circuit 40 may be modified to permit the value of both sample coin 30 and sample coin 32 to be adjusted. This alternative embodiment is accommodated by providing sample coin coil assembly 30 with an additional programmable multiple credit circuit of the type disclosed herein in relation to sample coin coil assembly 32.

Shown in FIG. 6 are the paths traversed by tested coin 34, both in the rejected and accepted conditions. As tested coin 34 is inserted through inlet slot 51, tested coin 34 passes through tested coin coil assembly 24. Detection circuit 40 compares the outputs of coil assemblies 20–24, and if no match is determined kicker coil 82 is not energized. Return spring 88 maintains kicker gate 80 in a closed or rejection condition, and tested coin 34*a* is forced laterally normal to the direction of accepted coin chute 52 and out through rejected coin port 54. Kicker gate 80 forces tested coin 34*a* out onto rejected coin ramp 56 where tested coin 34*a* subsequently rolls out onto sloped upper end 60 and drops down through rejected coin chute 58. In the event that detection circuit 40 determines a match, kicker coil 82 is energized, causing kicker gate 82*b* to be withdrawn through gate aperture 86. Tested coin 34*a* thus drops vertically down through accepted coin chute 52 toward the coin storage box, passing confirmation sensor 36. Credit is extended to the user, and kicker mechanism 28 is reset.

Figure 10:
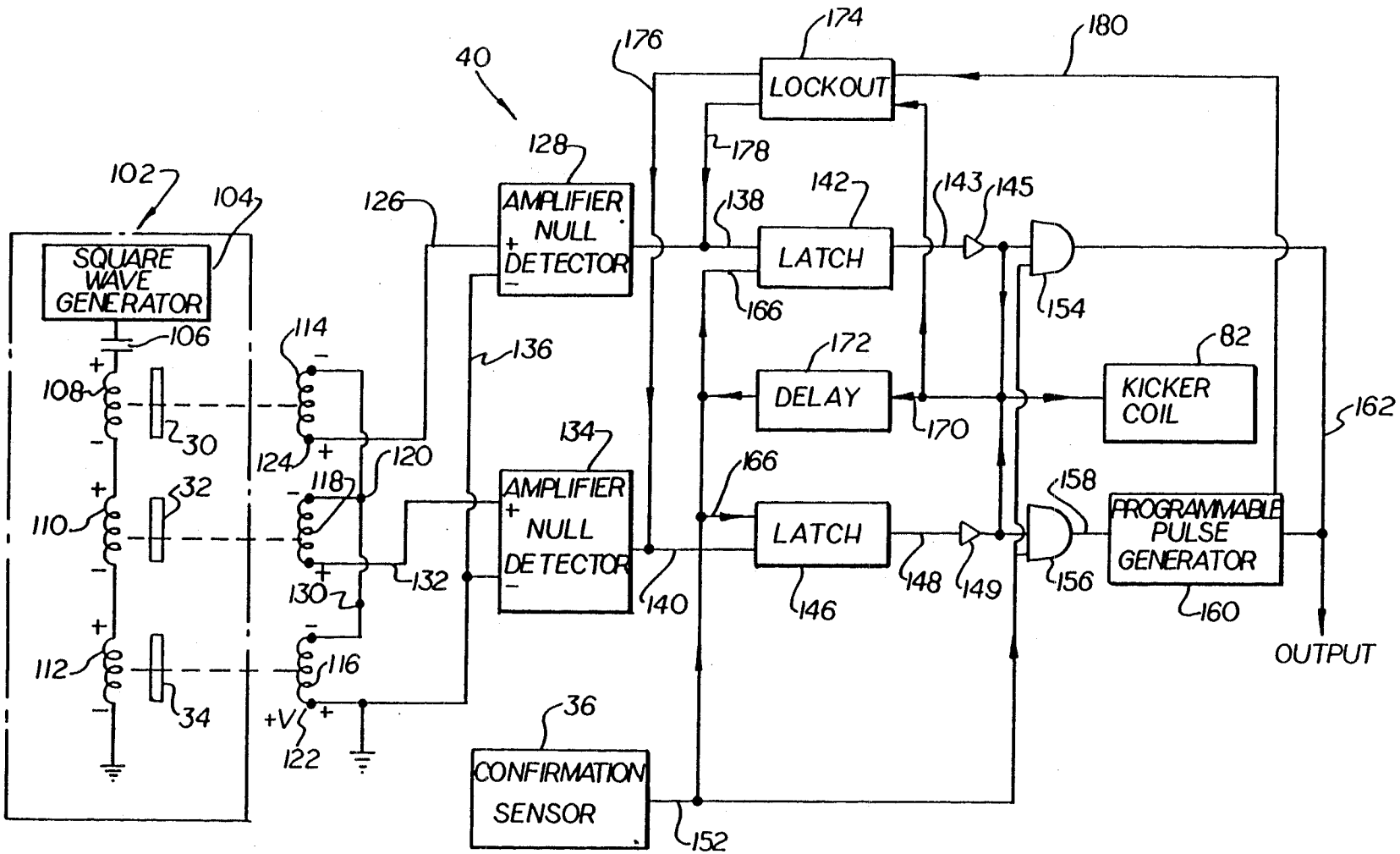
FIG. 10 is a block diagram of the detecting circuit embodying the present invention.

A block diagram of the circuit 40 for the present invention is illustrated in FIG. 10. Detection circuit 40 includes a field generating means 102 for generating a magnetic field. Field generating means 102 includes a square wave generator 104 connected through a capacitor 106 to a series circuit combination of field generating coils 108, 110 and 112 to provide the coils with a differentiated square wave current. A first field detecting means illustrated as a detecting coil 114 is positioned closely adjacent generating coil 108 in order to detect the intensity of the portion of the field generated by coil 108. A second field detecting means illustrated as detecting coil 116 is positioned closely adjacent generating coil 110 in order to detect the intensity of the portion of the magnetic field generated by coil 110. A third field detecting means illustrated as a detecting coil 118 is positioned closely adjacent generating coil 112 to detect the intensity of the portion of the field generated by coil 112. Coils 110 and 116 are part of tested coin coil assembly 24, and are positioned on opposite sides of test region 50 and respond to the change in the magnetic field created by the presence of tested coin 34. Coils 108 and 114 are part of sample coin coil assembly 20, and are spacedly positioned on opposite sides of sample coin coil assembly 20 to respond to the change in the magnetic field resulting from first sample coin 30. Coils 112 and 118 are part of sample coin coil assembly 22 and are spacedly positioned on opposite sides of sample coin coil assembly 20 to respond to the change in the magnetic field created by second sample coin 32.

Figure 11:
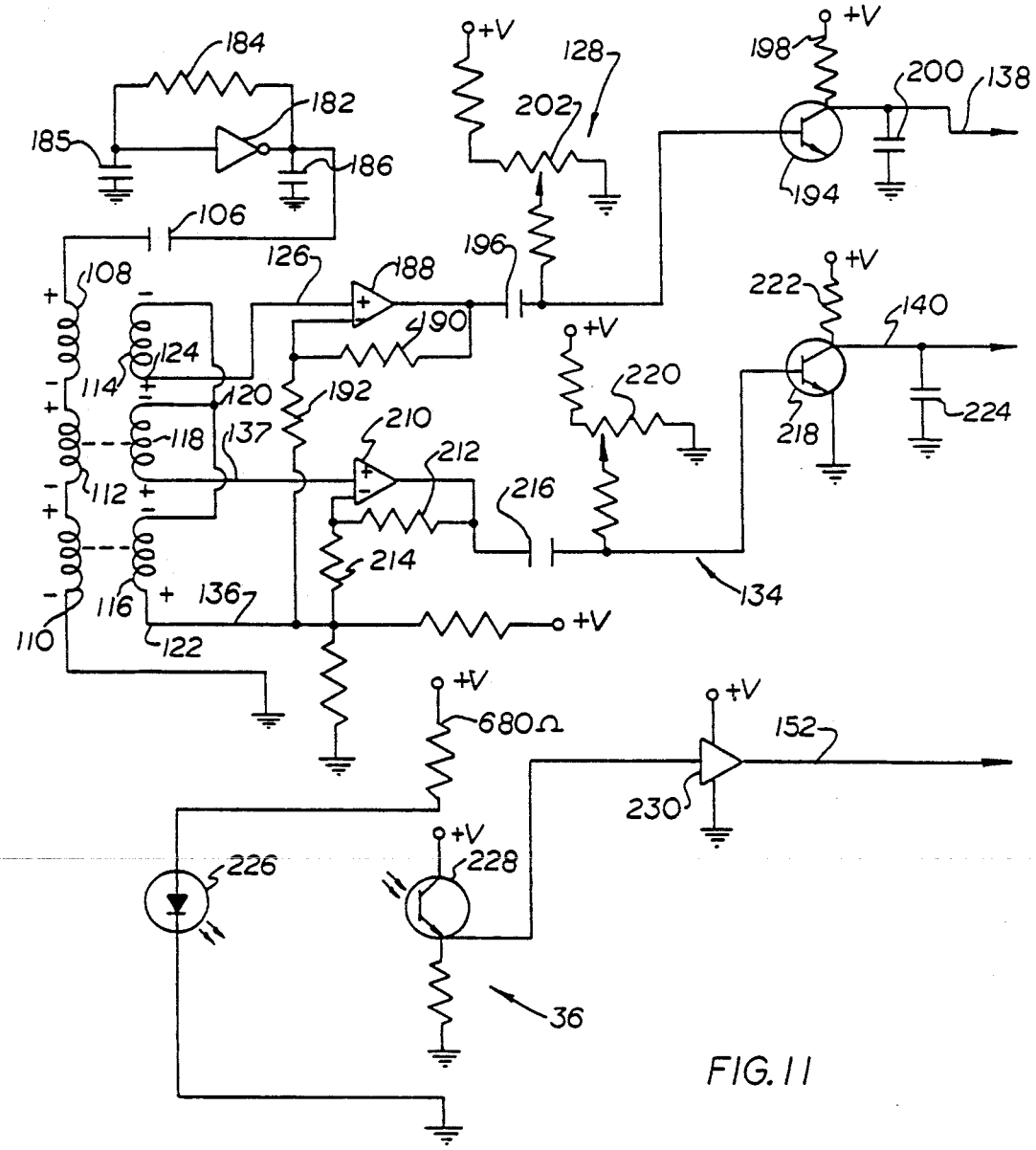
FIG. 11 and 11*a* is a schematic diagram of the detecting circuit of FIG. 10.
Figure 11A:
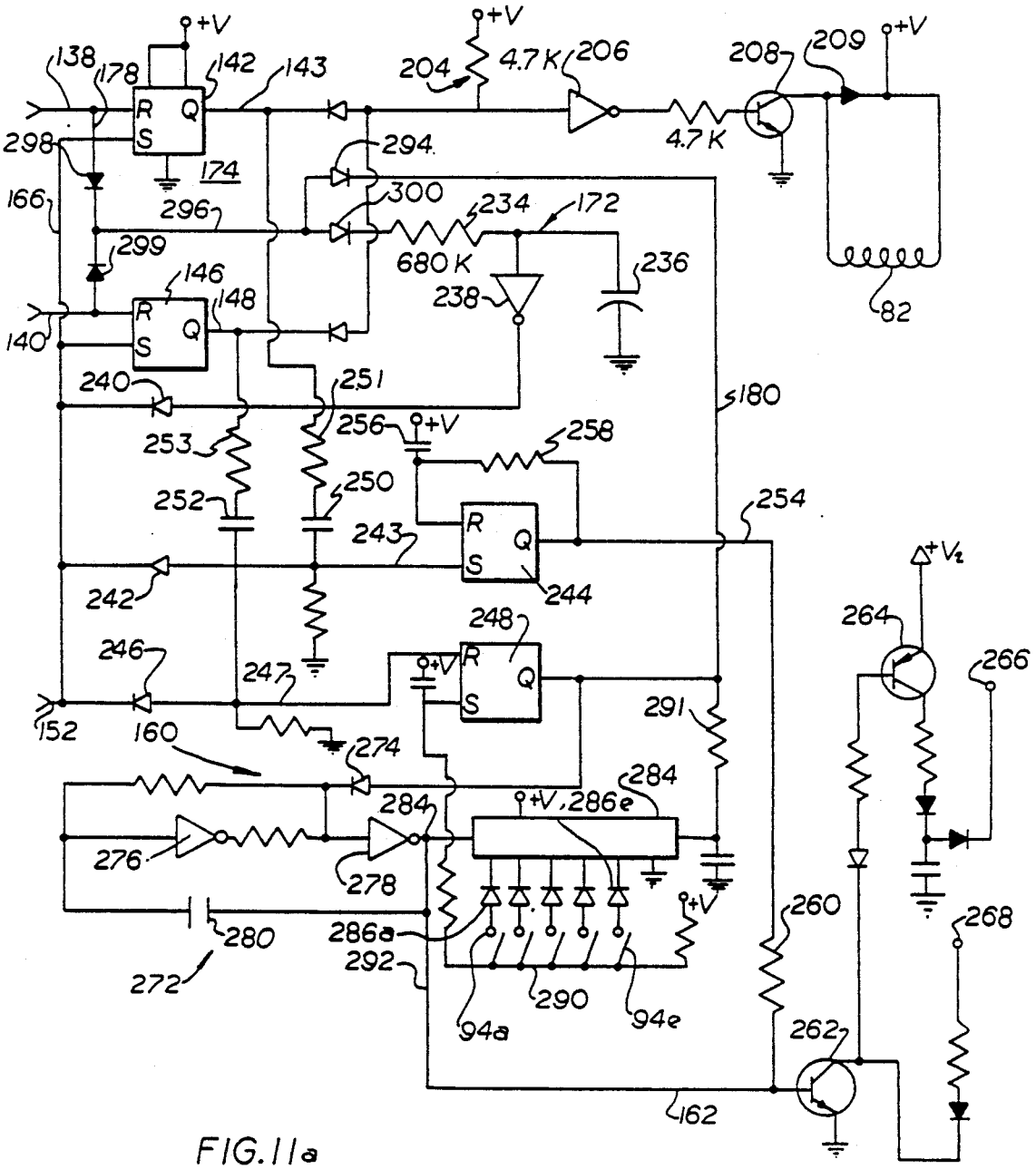

First terminal ends of detecting coils 114, 116 and 118 are interconnected at a junction 120. The coils are configured to generate an electric current in a given one direction in response to a predetermined magnetic field orientation. Coils 114–118 are interconnected such that their terminals of like polarity are interconnected at junction 120. The polarity of the coils is indicated in FIGS. 10 and 11 only to show relative polarity between the coils, and the polarity could be reversed. An opposite terminal end 122 of coil 116 is connected to signal ground. An opposite terminal 124 of coil 114 is connected by a conductor 126 to the input terminal of an amplifier and null detector 128. An opposite terminal 130 of detecting coil 118 is connected by a conductor 132 to the input terminal of an amplifier and null detector 134.

Amplifier/null detector 128 is thus responsive to the AC voltage developed across detecting coils 114 and 116. Similarly, amplifier/null detector 134 is responsive to the AC voltage developed across detecting coils 118 and 116. Because the coils 114, 116 and 118 are interconnected at terminal 120 with their terminals of same polarity, the current generated in coil 116 is opposite to that generated in coils 114 and 118 and tends to cancel these currents. When no tested coin 34 is positioned between coils 110 and 116, the current induced in coil 114 by coil 108 produces a relatively large signal voltage at the input terminal of amplifier/null detector 128. Similarly, when no tested coin 34 is present between coils 110 and 116, the current induced in coil 118 by coil 112 produces a relatively large signal voltage across the terminal of amplifier/null detector 134. Thus, the quiescent condition is for amplifier and null detectors 128 and 134 to be presented with relatively large input voltages.

Amplifier/null detector 128 produces an output voltage on a conductor 138 which is at a low state in response to the quiescent large input voltage to amplifier/null detector 128. Similarly, amplifier/null detector 134 produces an output voltage on a conductor 140 which is at a low state in response to the large input voltage on amplifier/null detector 134 in a quiescent state. When a tested coin 34 is deposited in inlet coin slot 51, it momentarily modifies the field between generating coil 110 and detecting coil 116 as it passes between these two coils. The modification to the magnetic field is such that the current generated in coil 116 is increased. If tested coin 34 is substantially identical to first sample coin 30 between coils 108 and 114, the modification to the magnetic field between coils 110 and 116 will be substantially the same as the change to field coils 108 and 114. Thus, the currents in coils 114 and 116, which tend to cancel each other, cause the voltage between lines 126 and 136 to reach a maximum null condition. The maximum null condition will cause the output of amplifier/null detector 128 to switch from a low to a high state.

Detection circuit 40 in determining a maximum null condition makes use of both the high and low frequencies of the generated square wave for comparison. The fast rise in frequency as well as the damped wave in the coils following each rise and fall of the square wave, which results in frequency ringing due to the series resonance of the coils, is utilized for comparison. Detection circuit 40 compares both the amplitude and the phase angle of the output of coil 116 with the outputs of coils 114 and 118. If both the amplitude and phase angle do not match, a maximum null condition is not created. A description of this frequency analysis in relation to a single sample coin and single test coin is included in U.S. Pat. Nos. 4,469,213 and 4,437,558 issued Sept. 4, 1984, and Mar. 20, 1984, respectively, to Raymond Nicholson and Donald O. Parker, the disclosures of which are included herein by reference.

Since coil 116 is connected to both amplifier/null detectors 128 and 136 while coils 114 and 118 are only connected to a single amplifier/null detector 128, 136, respectively, even when a genuine tested coin 34 is compared with sample coins 30, 32 a resistive imbalance between the sample coin coil 114, 118 and tested coin coil 116 will result. If amplifier/null detectors 128 and 136 are provided with a high input impedance any such resistive imbalance between tested coin coil 116 and sample coin coils 114, 118 becomes insignificant in relation to the magnitude of the null comparison with an unmatched or nongenuine coin. Adjustment of the selectivity of amplifier/null detectors 128 and 134 compensates for this insignificant resistive unbalance. Alternatively, to correct this resistive imbalance a shunt resistor (not shown) may be placed across each sample coin coil 114 and 118 equal to the input resistance of the respective amplifier/null detectors 128, 134.

While the presence of a tested coin 34 that is identical to first sample coin 30 will cause the voltage across terminals 130 and 122 to decrease somewhat, the difference between tested coin 34 and second sample coin 32 between coils 112 and 118 will result in only a minor null between terminals 130 and 122 which is insufficient to cause a change in the state of the output of amplifier 134. Similarly, a tested coin 34 passing between coils 110 and 116 which is substantially identical to second sample coin 32 positioned between coils 112 and 118 will cause a maximum null condition to occur between lines 132 and 136. The maximum null condition will cause the output of amplifier/null detector 134 to switch from low to a high state.

Thus, it is seen, that if tested coin 34 is identical to first sample coin 30, the output of amplifier 128 will respond to the maximum null condition by switching the output on line 138 to a high state. The amplifier/null detector 134 remains in a quiescent condition with its output on conductor 140 in a low state. If tested coin 34 is identical with second sample coin 32, amplifier/null detector 134 will respond to the maximum null condition by switching the output on line 140 to a high state.

Output line 138 of amplifier/null detector 128 is connected to the latching (reset) input terminal of a latch 142. Latch 142 initially is in a set condition with a high output state. The positive going pulse produced on line 138 by a match between tested coin 34 and first sample coin 30 causes the output of latch 142 on a line 143 to switch to a latched or low state. Line 143 is connected through inverter 145 to kicker coil 82 which energizes kicking gate 80 in order to shift out of accepted coin chute 52 and permit tested coin 34 to drop into accepted coin storage box. Output line 140 of amplifier/null detector 134 is connected to the latching (reset) input terminal of a latch 146. Latch 146 is also initially in a set condition with a high output state. A positive going pulse on line 140, resulting from a match between tested coin 34 and second sample coin 32, causes the output of latch 146 on a line 148 to switch to a low state which is connected to kicker coil 82 through an inverter 149 and likewise energizes kicker coil 82 to shift kicker gate 80 out of accepted coin chute 52 and permit tested coin 34 to drop down into the coin storage box.

Tested coin 34, when permitted by kicker mechanism 28 to drop into the coin box, will pass confirmation sensor 36 producing a positive going pulse on a conductor 152. Conductor 152 in turn is connected to a pair of AND gates 154 and 156. The other input to AND gate 154 is connected to the output of latch 142 through inverter 145. Thus, when a match occurs between tested coin 34 and first sample coin 30 positioned between coils 108 and 114, the output of inverter 145 is switched to a high state and, once tested coin 34 passes confirmation sensor 36, line 152 becomes positive. When conductor 152 goes positive in response to test coin 34 passing confirmation sensor 36, the two positive inputs to AND gate 154 causes a output line 162 to switch to produce a single positive pulse on line 162. Thus, for a match between tested coin 34 and second sample coin 30, a single credit is given.

The second input to AND gate 156 is the output from latch 146 which is inverted by an inverter 149 and assumes a positive state when there exists a match between tested coin 34 and second sample coin 30 positioned between coils 112 and 118. When conductor 152 goes positive in response to test coin 34 passing confirmation sensor 36, the two positive inputs cause AND gate 156 to produce a positive output on a line 158 which is provided as an input to a programmable pulse generator 160. Pulse generator 160 responds to the positive voltage on line 158 by producing a predetermined number of pulses on output line 162. The number of pulses produced on line 162 by generator 160 may be preset by programming means provided with pulse generator 160, which programming means is adjusted by switches 94. Each pulse on line 162 is interpreted by the underlying coin operated equipment to which circuit 100 is connected as one credit. From the above it will be noted that credit is not given for a match between tested coin 34 and either first sample coin 30 or second sample coin 32 until tested coin 34 passes confirmation sensor 36. In this manner detection circuit 40 prevents the awarding of unwarranted credit, such as, for example, in the event a genuine tested coin 34 is lowered by a line past coils 110 and 116 but withdrawn prior to reaching confirmation sensor 36.

Output conductor 152 from confirmation sensor 36 is additionally connected to the set inputs of latches 142 and 146 through a line 166. Thus, the outputs from AND gates 154 and 156 are at a positive state only for the period of time that it takes a test coin to move from the test position between coils 110 and 116, where either latch 142 or 146 may be shifted to the latched condition, to the location of confirmation sensor 36 where the latch (142 or 146) is shifted to the set condition.

A line 170, which extends from the outputs of latches 142, 146 to kicker coil 82, also provides an input to a delay circuit 172. The output from delay circuit 172 is provided to line 166 to set latches 142 and 146 a predetermined time lag after kicker coil 82 is energized, which occurs in response to the latching of either latch 142 or 146. Thus, if the respective latch is not set by the output of confirmation sensor 150 before delay circuit 172 times out, the appropriate latch 142 or 146 will be set by the output of delay circuit 172. Thus, circuit 172 provides a supervisory set in order to set circuit 40 to prepare for the testing of a new coin in case the accepted coin fails to energize confirmation sensor 36. Otherwise, circuit 40 could become inoperative by being locked in an indeterminate latched state. Such an indeterminate state occurring, for example, by a genuine tested coin being lowered on a line past coils 110 and 116 but then withdrawn prior to reaching confirmation sensor 36 in an attempt to cheat detection circuit 40. Since latches 142 and 146 are set in response to tested coin 34 passing confirmation sensor 36, in the event a genuine tested coin 34 is lowered on a line down to confirmation sensor 36 and therefore credit is received, kicking gate 80 returns to its at-rest position, the rejecting condition, and thus impedes the withdrawal of tested coin 34 back up accepted coin chute 52.

Conductor or line 170, which senses the condition of kicker coil 82, additionally is provided as an input to a lockout circuit 174. Lockout circuit 174 has outputs 176 and 178 connected to conductors 140 and 138 respectively. When one of amplifier/null detectors 128 and 134 produces a positive pulse thus energizing lockout circuit 174 with kicker coil 82 energized, outputs 176 and 178 hold conductors 138 and 140 in a low state to prevent an erroneous output signal from being inadvertently developed at either amplifier/null detector 128 or 134. One function of lockout circuit 174 therefore is to prevent a tested coin 34 from receiving multiple or otherwise incorrect credit erroneously through the erroneous switching of the output from latches 142 and 146 to a high state. Additionally, a conductor 180 extending from programmable pulse generator 160 to lockout circuit 174 provides a second input to lockout circuit 174. Conductor 180 causes lockout circuit 74 to be energized during the period of time that programmable pulse generator 160 is producing pulses on output line 162. The purpose of this arrangement is to prevent a second tested coin from being accepted by the system during the period of time when the pulse generator 60 is producing pulses because, during this period of time, any credit pulse produced in response to the second coin could be produced simultaneously with a pulse from pulse generator 160 in response to the first tested coin 34, which would not be recognized by the equipment to which circuit 40 is connected. Thus, lockout circuit 174 prevents the loss of credit for the second tested coin by causing the second coin to be rejected.

Referring now to the detailed schematic of detection circuit 40 illustrated in FIG. 11, square wave generator 104 is an inverter buffer 182 that includes a Schmitt trigger input device having a feedback resistor 184 capacitor 185, which is a square wave oscillator circuit. Most preferably detection circuit 40 makes use of a Motorola Mc 14584 circuit component which includes Schmitt trigger input device 182. Output capacitor 186 filters out very high frequency components from the output of the oscillator circuit resulting from the very rapid switching times of circuit 182. The output of generator 104 is connected to the series combination of coils 108, 112 and 110 through capacitor 106 to provide a differentiated square wave current to the coils. Terminal 122 is connected to direct current "+V" and to ground through two resistors 187 of substantially the same value, which operates as a voltage divider. A capacitor 189 operates as a signal ground to the AC signal used on coil 116.

Amplifier/null detector 128 includes a linear amplifier 188 which is biased through a feedback resistor 190 and an input resistor 192 connected to its inverting input to have a gain of approximately four hundred seventy. The non-inverting input of amplifier 188 is connected to line 126. Because capacitor 189 produces a signal ground on line 136, amplifier 188 produces an output that is proportioned to the signal voltage across coils 114 and 116. The output of amplifier 188 is connected to the base of a transistor 194 through a filtering capacitor 196. The purpose of capacitor 196 is to eliminate any DC offset from amplifier 188 and to pass only AC signals to transistor 194. The emitter of transistor 194 is grounded and the collector is connected to "+V" through a biasing resistor 198. The collector of transistor 194 is the output from amplifier/null detector circuit 128 and is provided on line 138. Conductor 138 is connected to ground through an integrating capacitor 200. The base of transistor 194 is connected to "+V" through an adjustable trimming resistor 202. The purpose of resistor 202 is to adjust the sensitivity of transistor 194 to the signal developed across conductors 126 and 136 and amplified by amplifier 188.

When amplifier/null detector 128 is in a quiescent state with no tested coin 34 between coils 110 and 116, the large bias voltage on the base of transistor 194 maintains the transistor in a saturated condition and the output of circuit 128 on line 138 in a low state. The negative going spikes developed by the differentiated oscillator and detected by the detecting coils periodically momentarily switches transistor 194 to a non-conducting state, causing the voltage on line 138 to tend to rise. However, the voltage on line 138 is not allowed to rise during the momentary negative spikes on the base of transistor 194 because integrating capacitor 200 acts as a filter. However, when a tested coin 34 passes between coils 110 and 116 which is substantially identical to first sample coin 30 positioned between coils 108 and 114, the null developed across conductors 126 and 136 provides a sufficiently reduced signal to the base of transistor 194 to cause it to be unsaturated for a sufficient period of time for a charge to develop across capacitor 200. The null that results from a match with the sample coin must be of sufficient duration to allow a charge of capacitor 200 to be sufficient to produce an input signal to latch 142 on its latching input. Trimming resistor 202 may be adjusted to establish the necessary threshold.

The positive input on the latching (reset) input of latch 142 causes output line 143 to switch to a low state. Output line 143 is connected to a "+V" through a pull-up resistor 204 and through an inverter 206 to the base of a driving transistor 208. Transistor 208 is connected in an open-collector configuration with the kicker coil 82, and kicker coil 82 is also connected to a damper or freewheeling diode 209 and a positive DC voltage. Thus, when the null signal developed by amplifier/null detector 128 causes latch 142 to be latched and the output signal on line 143 to switch to a low state, the input to inverter 206 is switched from a high to a low state which causes its output to switch from a low to a high state driving transistor 208 to energize kicker coil 82 which in turn moves kicking gate 80 out of accepted coin chute 52 and allows tested coin 34 to drop into the coin box.

Similarly, amplifier/null detector 134 includes an amplifier 210 having a feedback and input resistors 212 and 214, respectively, of preselected values connected to its inverting input to cause the amplifier 210 to have a gain of approximately four hundred seventy. Its non-inverting input is connected to line 137 and is thus responsive to the signal developed across coils 118 and 116. The output of amplifier 210 is connected through a filter capacitor 216 to the base of a transistor 218. The base of transistor 218 is additionally connected to a positive voltage terminal through a trimming resistor 220. The collector of transistor 218 is connected to "+V" through a biasing resistor 222 and to output line 140. Output line 140 is, in turn, connected to ground through an integrating capacitor 224. Line 140 is connected to the latching input of latch 146 whose output line 148 is likewise connected to the input of inverter 206. In response to a sufficiently deep null signal provided on line 137, the positive going pulse on line 140 will cause latch 146 to latch causing output 148 to switch to a low state. Line 148, switching to a low state, will cause the input of inverter 206 to switch from a high to a low state and the output of inverter 206 from a low to a high state. This drives transistor 208 to energize kicker coil 82, withdrawing kicker gate 80 and permitting tested coin 34 to drop into the coin box.

Confirmation sensor 36 includes a light emitting diode 226 and a photo transistor 228 arranged so that a tested coin 34 dropping along accepted coin chute 52 will break the light path between diode 226 and transistor 228 causing transistor 228 to momentarily turn off. This presents a negative going pulse to the input of a Schmitt trigger inverting device 230 which produces a positive going pulse, having a fast rise and fall time, on line 152. Line 152 is connected through a resistor 232 to the set inputs of latches 142 and 146 on line 166. Thus, a tested coin 34 passing between diode 226 and transistor 228 will set latches 142 and 146 to provide positive levels on output lines 143 and 148, representative of a quiescent state. This, in turn, will cause the input to inverter 206 to go high and its output low turning off transistor 208 and de-energizing kicker coil 82. Kicker gate 80 will therefore move to its at-rest rejecting condition as a result of return spring 88.

Line 170, which provides the input to inverter 206, is connected through a series combination of a resistor 234 and a capacitor 236 to ground. Resistor 234 and capacitor 236 define delay circuit 172 whose output is connected through an inverter 238 and a diode 240 to line 166 connected to the set terminals of latches 142 and 146. Capacitor 236 is normally fully charged through resistors 204 and 234. When one output conductor 143 or 148 switches to a low state, indicating that a tested coin 34 matches one of sample coins 30 and 32, line 170 goes low which causes capacitor 236 to gradually discharge through resistor 234. When the threshold of inverter 238 is reached, its output switches from a low to a high state which sets latches 142 and 146. Thus, regardless of the operation of confirmation sensor 150, latches 142 and 146 will be set after a predetermined time which is defined by the values of capacitor 236 and resistor 234 to provide a supervisory set function.

The output from confirmation circuit 150 on line 152 is additionally connected through a diode 242 to a set input line 243 of a latch 244 and through a diode 246 to a reset input line 247 of a latch 248. Set input line 243 is connected to output line 143 of latch 142 through a capacitor 250 and resistor 251. Set input line 247 is connected to output line 148 of latch 146 through a capacitor 252 and resistor 253. When output lines 143 and 148 from latches 142 and 146, respectively, are in their quiescent (positive) state and the output on line 152 from confirmation sensor 150 is in its quiescent (low) state, capacitors 250 and 252 become fully charged through resistors 251 and 253, respectively. Inputs 243 and 247 to latches 244 and 248, respectively, are maintained in a low state through diodes 242 and 246, respectively.

When the output of latch 142 on line 143 switches to a low state in response to a match between a tested coin 34 and first sample coin 30 positioned between coils 108 and 114, capacitor 250 discharges through resistor 251. Input line 243 remains in a low state because of the low state of line 152. When tested coin 34 passes through confirmation sensor 36, output line 152 goes high, setting the output of latch 142 on line 143 to a positive state. Because capacitor 250 is discharged and the voltage across the capacitor cannot instantaneously change, input line 243 to latch 244 is momentarily pulled to a high state for the period that it takes capacitor 250 to recharge. This sets the output 254 of latch 244 to a high state. The reset input to latch 244 is connected to a positive voltage through a capacitor 256 and to output 254 through a resistor 258. Thus, latch 244 will be reset within a predetermined time after output 254 switches to a high state as a result of capacitor 256 and resistor 258. Thus, a pulse of predetermined width is produced on output 254 which connects through a resistor 260 to output line 162. Output line 162 connects through a buffer transistor 264 connected to a "$+V_2$" terminal and having its emmiter connected through a triac 267 to output terminal 266, as well as through transistor 262 to output terminal 268, in order to interface and accommodate both AC and DC triggered equipment of the underlying mechanism with which apparatus 10 is used.

In the above example, output line 148 will be in a high state as a result of no match between tested coin 34 and second sample coin 32 between coils 112 and 118 when the output 152 of confirmation sensor 150 switches to a high state. Capacitor 252 will remain fully charged Thus, when the output from confirmation sensor switches to a high state, the charge on capacitor 252 will keep diode 246 reversed biased which will prevent the input line 247 to latch 248 from switching to a high state.

If output line 148 switches to a low state in response to a match between tested coin 34 and second sample coin 32, the low state of line 148 will discharge capacitor 252 through resistor 253 so that, when the switching of line 152 sets latch 146 back to a quiescent (high) state, the fact that capacitor 252 is discharged, will cause input line 247 to also switch to a high state This resets latch 248 causing its output produced on a line 270 to switch from a high state to a low state.

Output line 270 is connected to an oscillator generally shown at 272, which includes an input diode 274, a pair of Schmitt trigger devices 276 and 278 and a feedback capacitor 280. When line 270 is in a high state, diode 274 is forward biased clamping the input to Schmitt trigger device 276 to a high state and its output in a low state which prevents oscillator 272 from producing pulses. When, however, output 270 switches to a low state in response to the input 247 of latch 248 switching to a high state, diode 274 becomes reversed biased and square wave oscillator 272 is enabled to produce pulses on its output line 282.

Line 282 is provided as an input to a counter circuit 284. Counter circuit 284 includes a plurality of outputs designated Q1 through Q5 inclusive. Each output is connected through a diode **286*a* through 286*e* and a switch 94*a* through 94*e* to a line 290. Line 290, in turn, is connected to the set input of latch 248. A reset line for counter 284 is connected through a resistor 291 to output 270 of latch 248. Each output Q1 through Q5 of counter 284 produces an output pulse in response to a unique predetermined number of input pulses from line 282. Thus, depending on which switch 94*a* through 94*e* is closed, line 290 will switch states after a predetermined number of pulses have been produced on line 282. The switching of states on line 290 sets latch 248 causing line 270 to switch to a high state which disables the square wave oscillator 272. The switching of line 270 to a positive state additionally resets counter 284 through resistor 291**.

Thus, when a match occurs between tested coin 34 and second sample coin 32 positioned between coils 112 and 118, output line 148 of latch 146 switches to a low state and when tested coin 34 has passed through confirmation detector 36, line 152 switches from a low to a high state causing latch 146 to be set and latch 248 be reset, as described above, causing output 270 to switch to a low state. This energizes oscillator 272 to produce pulses on output 282. Counter 284 counts the pulses on line 282 and produces a pulse on each output Q1 through Q5 after the unique predetermined number of pulses associated with the respective output. Depending on which switch **94*a* through 94*e* is closed, latch 248 will be set after the respective predetermined number of pulses are counted by counter 284. This causes output line 270 to switch to a high state which disables oscillator 272 and resets counter 284. The pulses produced at output 282 are provided through a resistor 292 to output line 162 and to output terminals 266 and 268. Thus, depending on which switch 94a through 94e is closed, a match between tested coin 34 and second sample coin 32 will cause a predetermined number of pulses to be produced on output terminals 266 and 268**

Output line 270 from latch 248 is also connected through line 180 and a diode 294 to an input inhibit line 296. Line 296 is, in turn, connected through a diode 298 to input line 138 of latch 142 and through a diode 299 to input line 140 of latch 146. Thus, when output 270 of latch 248 is in a low state, which occurs while pulses are being produced on output terminals 266 and 268, input line 138 is clamped in a low state and prevented from switching to a high state by forward biased diodes 298 and 294. Line 140 is likewise prevented from switching to a high state by forward biased diodes 299 and 294. Thus, neither latch 142 or 146 is capable of changing states during the period that pulses are being dispensed on output terminals 266 and 268. This prevents lost credits as a result of feeding two tested coins 34 in rapid succession into inlet coin slot 51. The present circuit causes the second coin to be rejected rather than accepted without giving credit therefor.

Input inhibit line 296 is additionally connected to line 170 through a diode 300, so that when one of output lines 143 and 148 are switched to a low state, the input lines 138 and 140 are clamped in a low state and prevented from erroneously switching to a high state with a resulting erroneous multiple crediting due to the erroneous signal.

The above is a description of a two sample coin detection circuit 40. Alternatively additional sample coin comparing circuits may be added, such as by adding additional sample coin coils between capacitor 106 and coils 108, 114 and adding amplifier/null detector and crediting circuits of the type described above.

It is to be understood that the above is a description of the preferred embodiment and that one skilled in the art will recognize that various improvements or modifications may be made without departing from the spirit of the invention that is disclosed herein. The scope of protection afforded is to be determined by the claims which follow and the breadth of interpretation that the law allows.

The embodiments of the invention in which an exclusive property or privilege is claimed are as follows:

1. A coin acceptor device, comprising:

a support frame;

a coin acceptance channel mounted on said support frame, said coin acceptance channel having a test region thereon;

a tested coin sensor located at said test region and having a tested coin output;

a first sample coin mount on said support frame and adapted to selectively secure a first sample coin;

a first sample coin sensor disposed at said first sample coin mount and having a first sample output;

a second sample coin mount on said support frame and adapted to selectively secure a second sample coin;

a second sample coin sensor disposed at said second sample coin mount and having a second sample output;

means for comparing said tested coin output concurrently with said first and second sample outputs and for determining whether said tested output is substantially the same as one of said first and second sample outputs.

2. The coin acceptor device of claim 1, further comprising:

a credit signal generator operatively coupled to said comparing means and adapted to generate a credit signal when said comparing means determines said tested output is substantially the same as either one of said first and second sample outputs.

3. The coin acceptor device of claim 2, wherein:

said credit signal generator is adapted to generate a first credit signal when said tested output is determined to be substantially the same as said first sample output, and is adapted to generate a second credit signal when said tested output is determined to be substantially the same as said second sample output.

4. The coin acceptor device of claim 3, wherein:

said credit value generator is adapted to generate said second credit signal having a selectively adjustable value.

5. The coin acceptor device of claim 4, wherein:

wherein credit signal generator is adapted to generate pulses, and said credit value generator is adapted to generate said second credit signal having an adjustably selected plurality of pulses.

6. The coin acceptor device of claim 1, further comprising:

a rejection member movably mounted at said test region and operatively coupled to said comparing means and adapted to move and direct a coin to be tested out of said coin acceptance channel in response to said comparing means determining said test coin output is not substantially the same as at least one of said first and second sample outputs.

7. The coin acceptor device of claim 6, further comprising:

a rejected coin channel having a rejection inlet disposed laterally adjacent said acceptance channel and said rejection member, said rejection member adapted to selectively shift a coin to be tested laterally normal to said coin acceptance channel through said rejection inlet.

8. The coin acceptor of claim 7, wherein:

said coin accepted channel includes an accepted coin region disposed to selectively receive a tested coin passed through said test region;

said coin acceptance channel is oriented generally vertically in said accepted coin region.

9. A method of determining whether a tested coin is substantially identical to any one of a plurality of sample coins comprising the steps of:

generating a magnetic field;

positioning each of said sample coins in sample coin zones of said magnetic field and a tested coin in a tested coin zone of said magnetic field;

detecting the intensity of said magnetic field in each of said zones;

simultaneously comparing the intensity of said field in said tested coin zone with the intensity of said magnetic field in each one of said sample coin zones.

10. The method of claim 9 further comprising:

said step of comparing includes determining that the intensity of said magnetic field in said tested coin zone is substantially identical to the intensity of said field in a determined one of said sample coin zones;

generating a credit signal in response to determining said magnetic field intensity in said tested coin zone is substantially identical to the intensity of said field in a determined one of said sample coin zones, said credit signal being different for each of said sample coin zones.

11. The method of claim 9, further comprising:

providing a coin acceptance path and a rejected coin path;

moving said tested coin along said coin acceptance path;

shifting said tested coin generally laterally normal to said coin acceptance path into said rejected coin path in response to said magnetic field intensity detected in said tested coin zone being different from said magnetic field intensity detected in each of said sample coin zones.

12. The method of claim 11, wherein:

said coin acceptance path provided is substantially vertical and said tested coin is selectively moved substantially vertically therethrough.

* * * * *

UNITED STATES PATENT AND TRADEMARK OFFICE

CERTIFICATE OF CORRECTION

PATENT NO. : 5,056,644

DATED : October 15, 1991

INVENTOR(S) : Donald O. Parker

It is certified that error appears in the above-identified patent and that said Letters Patent is hereby corrected as shown below:

Column 4, Line 30
"so a" should be --so as--

Column 4, Line 57
"panel 4" should be --panel 42--

Column 4, Line 58
After "direct" insert --a--

Column 9, Line 58
"a output" should be --an output--

Column 11, Line 4
"74 to" should be --174 to--

Column 11, Line 9
"generator 60" should be --generator 160--

Column 14, Line 19
After "state" insert --.--

Column 15, Line 6
After "268" insert --.--

UNITED STATES PATENT AND TRADEMARK OFFICE

CERTIFICATE OF CORRECTION

PATENT NO. : 5,056,644

DATED : October 15, 1991

INVENTOR(S) : Donald O. Parker

It is certified that error appears in the above-identified patent and that said Letters Patent is hereby corrected as shown below:

Column 16, line 23, "wherein credit" should be --said credit--.

Signed and Sealed this

Twenty-ninth Day of June, 1993

Attest:

Michael K. Kirk

MICHAEL K. KIRK

Attesting Officer

Acting Commissioner of Patents and Trademarks